US010655376B2

(12) United States Patent
Saylor

(10) Patent No.: US 10,655,376 B2
(45) Date of Patent: May 19, 2020

(54) DISHWASHER DOOR WITH COUNTERBALANCE ASSEMBLY

(71) Applicant: Whirlpool Corporation, Benton Harbor, MI (US)

(72) Inventor: Zachary J. Saylor, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 246 days.

(21) Appl. No.: 15/658,640

(22) Filed: Jul. 25, 2017

(65) Prior Publication Data

US 2018/0044960 A1 Feb. 15, 2018

Related U.S. Application Data

(60) Provisional application No. 62/372,836, filed on Aug. 10, 2016.

(51) Int. Cl.

| | |
|---|---|
| ***E05F 1/10*** | (2006.01) |
| ***F24C 15/02*** | (2006.01) |
| ***D06F 58/20*** | (2006.01) |
| ***A47L 15/42*** | (2006.01) |
| ***D06F 39/14*** | (2006.01) |

(52) U.S. Cl.

CPC ..... *E05F 1/1075* (2013.01); *A47L 15/4261* (2013.01); *D06F 39/14* (2013.01); *D06F 58/20* (2013.01); *E05Y 2201/638* (2013.01); *E05Y 2201/66* (2013.01); *E05Y 2201/668* (2013.01); *E05Y 2201/67* (2013.01); *E05Y 2900/312* (2013.01); *F24C 15/023* (2013.01)

(58) Field of Classification Search

CPC .... E05F 1/1075; A47L 15/4261; D06F 39/14; D06F 58/20; E05Y 2201/67; E05Y 2900/312; E05Y 2201/638; E05Y 2201/66; E05Y 2201/668; F24C 15/023

See application file for complete search history.

(56) References Cited

U.S. PATENT DOCUMENTS

| | | | | |
|---|---|---|---|---|
| 2,757,663 | A * | 8/1956 | Pearce | F24C 15/023 126/194 |
| 2,833,270 | A * | 5/1958 | Brown | C10B 25/06 126/191 |
| 2,921,575 | A * | 1/1960 | Fry | F24C 15/023 126/191 |
| 3,049,114 | A * | 8/1962 | Carnahan | F24C 15/023 126/191 |
| 3,049,115 | A * | 8/1962 | Carnahan | F24C 15/023 126/191 |

(Continued)

*Primary Examiner* — Benjamin L Osterhout

(74) *Attorney, Agent, or Firm* — McGarry Bair PC

(57) ABSTRACT

A dishwasher comprising a cabinet, a door, and a counterbalance assembly coupling the cabinet to the door. The counterbalance assembly has a guide member with a rotatable pulley with a fixed radius and a cam affixed to one side of the pulley and having a varying radius. The cam and the pulley rotate about a pulley axis of rotation as a single unit. The counterbalance has a force applicator that applies a counterbalance force to one of the pulley or cam, and the counterbalance has a connector that couples the other of the pulley or cam to the door. The counterbalance force applies a varying counterbalance torque to the door that is a function of the ratio between the fixed radius and the varying radius over the pivotal range of the door.

22 Claims, 5 Drawing Sheets

(56) References Cited

U.S. PATENT DOCUMENTS

| | | | | |
|---|---|---|---|---|
| 3,466,105 | A * | 9/1969 | Guth | A47L 15/4261 312/274 |
| 3,820,866 | A * | 6/1974 | Kaldenberg | A47L 15/4261 312/276 |
| 8,042,891 | B2 | 10/2011 | Tynes et al. | |
| 8,985,717 | B2 * | 3/2015 | Marzorati | E05F 1/1261 16/286 |
| 9,055,857 | B2 | 6/2015 | Hotz et al. | |
| 9,498,102 | B2 * | 11/2016 | Chae | A47L 15/4261 |
| 2004/0113531 | A1 * | 6/2004 | Raches | A47L 15/4261 312/319.2 |
| 2008/0272678 | A1 * | 11/2008 | Tynes | A47L 15/4261 312/319.4 |
| 2009/0072686 | A1 * | 3/2009 | Vooren | A47L 15/4261 312/319.4 |
| 2011/0131886 | A1 * | 6/2011 | Durr | A47L 15/4261 49/386 |
| 2011/0215691 | A1 | 9/2011 | Keskin et al. | |
| 2011/0241507 | A1 * | 10/2011 | Diebold | A47L 15/4261 312/228 |
| 2016/0348919 | A1 * | 12/2016 | Ivanovic | E05F 1/1261 |

* cited by examiner

DISHWASHER DOOR WITH COUNTERBALANCE ASSEMBLY

CROSS-REFERENCE TO RELATED APPLICATIONS

The present application claims the benefit of U.S. Provisional Patent Application No. 62/372,836, filed Aug. 10, 2016, which is incorporated by reference herein in their entirety.

BACKGROUND

A dishwasher typically includes a structural support system comprising a cabinet within which a washing chamber resides, wherein the cabinet defines a front opening. The front opening is configured to be engaged by a pivotally supported door used to close the opening. The door is typically hinged at the lower end such that the door can be opened by pivoting downward so as to permit access to the interior of the washing chamber. The dishwasher may include a device for balancing or counterbalancing the weight of the door, when opening and closing the door.

BRIEF SUMMARY

The present disclosure relates to a dishwasher that comprises a cabinet that defines an access opening. The dishwasher has a door hingedly mounted to the cabinet and pivotable about a door axis of rotation between a pivotal range between opened and closed positions to selectively open/close the access opening. The dishwasher also has a counterbalance assembly coupled the cabinet to the door. The counterbalance assembly has a guide member with a rotatable pulley that rotates about a pulley axis of rotation and has a fixed radius from the pulley axis of rotation. The guide member also has a varying radius from the pulley. The counterbalance has a force applicator that applies a counterbalancing force to one of the pulley or cam, and the counterbalance has a connector that couples the other of the pulley or cam to the door. The counterbalance force applies a varying counterbalance torque to the door that is a function of the ratio between the fixed radius and the varying radius over the pivotal range of the door.

The present disclosure also relates to a method of counterbalancing a dishwasher door pivotal about a range of rotation between an opened position and a closed position. The method comprises applying a varying counterbalancing force to the dishwasher door throughout the range of rotation to effect at least two of true-hold, auto-close, or slow-open of the door.

The present disclosure also relates to an appliance that comprises a cabinet that defines an access opening. The appliance has a door hingedly mounted to the cabinet and pivotable about a door axis of rotation between a pivotal range between opened and closed positions to selectively open/close the access opening. The appliance also has a counterbalance assembly coupled the cabinet to the door. The counterbalance assembly has a guide member with a rotatable pulley that rotates about a pulley axis of rotation and has a fixed radius from the pulley axis of rotation. The guide member also has a varying radius from the pulley. The counterbalance has a force applicator that applies a counterbalancing force to one of the pulley or cam, and the counterbalance has a connector that couples the other of the pulley or cam to the door. The counterbalance force applies a varying counterbalance torque to the door that is a function of the ratio between the fixed radius and the varying radius over the pivotal range of the door.

DETAILED DESCRIPTION

Figure 1:
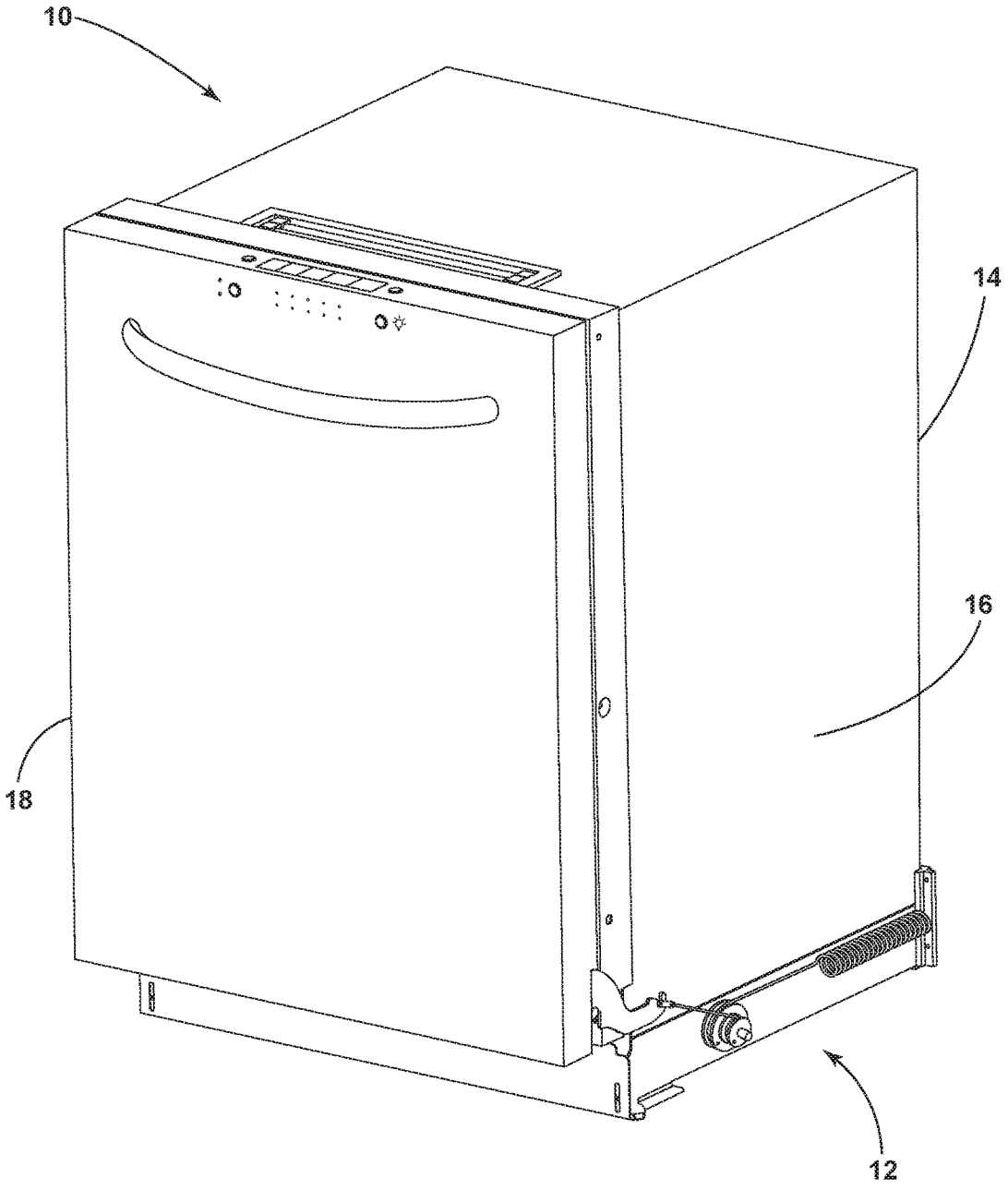
FIG. 1 is a perspective view of a dishwasher with a counterbalance assembly.

FIG. 1 shows a perspective view of a household appliance 10 of the type incorporating aspects of the current disclosure in the environment of a dishwashing machine. Although reference is made herein to a dishwasher 10, it is understood that the counterbalance assembly 12 is adapted to be used with other devices where pivoting between a door and a body and is not necessarily limited to a dishwasher. For example, the counterbalance assembly 12 can be used with other home or kitchen appliances, such as an oven, a washer or dryer, or can be used outside the home appliance art.

The dishwasher 10 appliance shares many features of a conventional dishwasher, which will not be described in detail herein except as necessary for a complete understanding of the illustrative embodiment in accordance with the present disclosure. The dishwasher 10 includes a structural support system comprising a cabinet 14 within which a washing chamber 16 having an access opening is provided. A door 18 is pivotally mounted, typically by a hinge, to the cabinet 14 and pivots between opened and closed positions to selectively open/close the access opening of the washing chamber 16. The door defines an arc relative to the door's axis of rotation and has a pivotal range between 0 and 90 degrees. The door is closed when it is at 0 degrees and open at 90 degrees. The pivotal range of the door can be further described to encompass three distinct portions: a first portion where the door is adjacent the open position, the arc of the door is generally between about 75 and 90 degrees, a second portion where the door is adjacent the closed position, the arc of the door is generally between about 0 and 15 degrees, and a third portion between the first and second portions, where the arc of the door is general between about 15 and 75 degrees.

A counterbalance assembly 12 is provided to counter the weight of the door 18 as it pivots through the operational range between the opened and closed positions. The counterbalance assembly 12 can be configured to counter, fully or partially, the weight of the door 18 through, all or part, of the door's operational range between the opened and closed positions. In this manner, the counterbalance assembly 12 can be configured to provide the same or different functionalities such as "hold" the door at any or all positions within the operational range, provide for an automatic closing of the door, or provide for a slow or damped opening of the door, to name a few. Although only one counterbalance assembly 12 is shown in FIG. 1, it is understood that there may be a counterbalance assembly 12 on both sides of the dishwasher 10.

Figure 2:
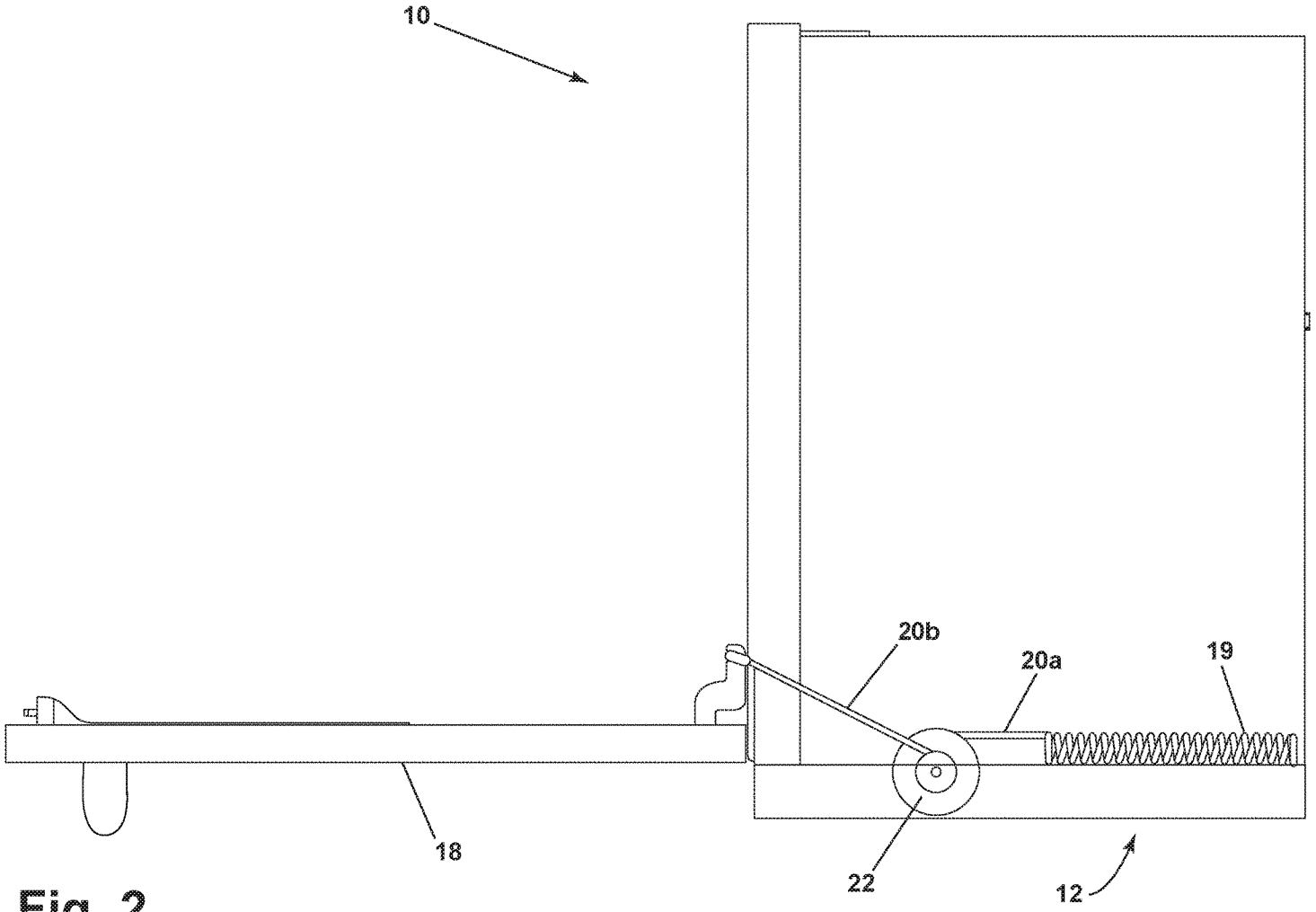
FIG. 2 is a side view of the dishwasher in FIG. 1 with a door in opened position.

FIG. 2 shows the counterbalance assembly 12 comprising a force applicator such as a biasing member 19, two connectors or flexible elements 20*a, b*, and a guide member 22, which cooperate to enable the door 18 to be pivoted between opened and closed positions while providing the desired functionalities, such as a true-hold, automatic closing or auto-close, or slow-open, throughout the entire operational range, at predetermined sub-range(s) of the operational range, a discrete location(s), or any combination of these functionalities and locations. The connector or flexible element 20*a, b* can be in the form of a cord, such as a braided material or other elastic materials capable of maintaining tension.

Figure 3:
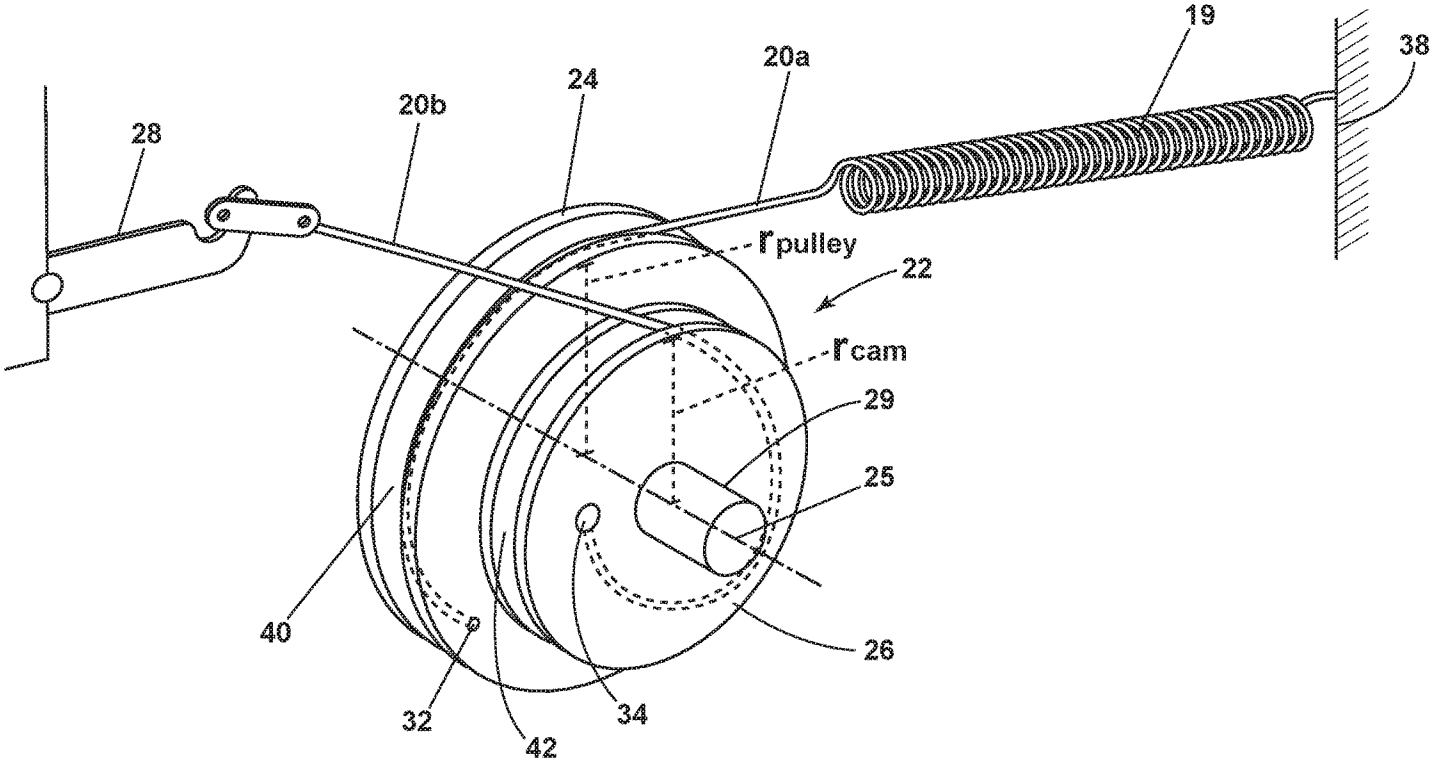
FIG. 3 is a perspective view of a counterbalance assembly having a guide member comprising a pulley and a cam.

FIG. 3 shows the detailed structure of the guide member 22 excerpted from the other parts of the counterbalance assembly 12. The guide member 22 includes a rotatable pulley 24 and a cam 26 affixed to one side of the pulley 24 where both parts rotate about a common axis 25 as a single unit. The rotatable pulley 24 and cam 26 can be of independent pieces or a monolithic structure. The rotatable pulley 24 has a fixed radius, $r_{pulley}$, from the axis of rotation 25 while the cam 26 has a varying radius, $r_{cam}$, measured from the axis of rotation 25. The rotatable pulley 24 and cam 26 can have respective guide tracks 40, 42 located about their periphery and in which the flexible elements 20*a, b* are received. A coupling member 29, which can be integrated to the cabinet 14 of the dishwasher 10, extends outwardly to engage the guide member 22 at its axis of rotation 25 and mount the guide member 22 to the cabinet. The guide member 22 is rotatable about the coupling member 29 such that the coupling member 29 forms the rotation axis 25.

Figure 4A:
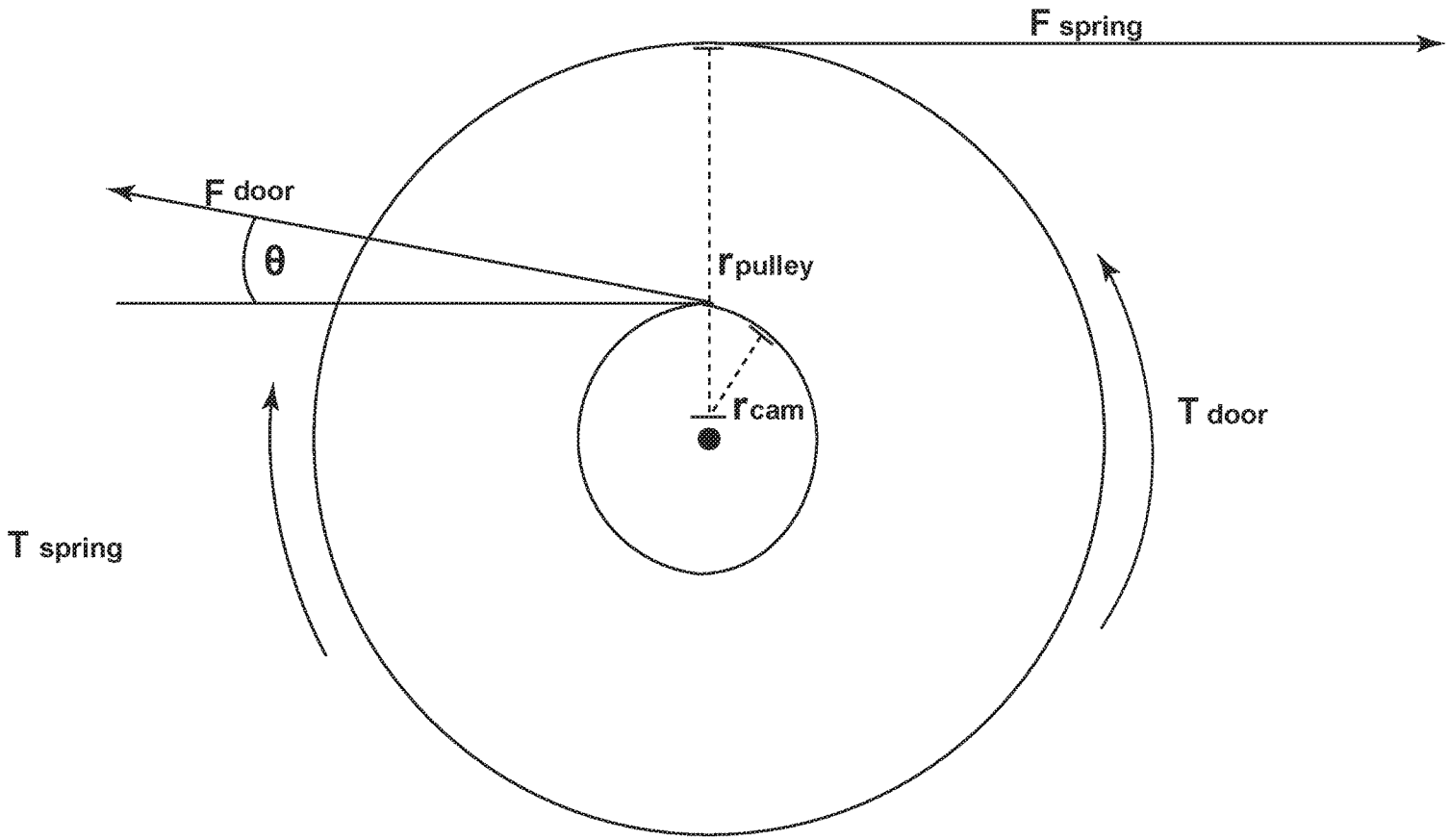
FIG. 4*a* is a schematic representation of the guide member and showing the forces acting upon the pulley and cam.
Figure 4B:
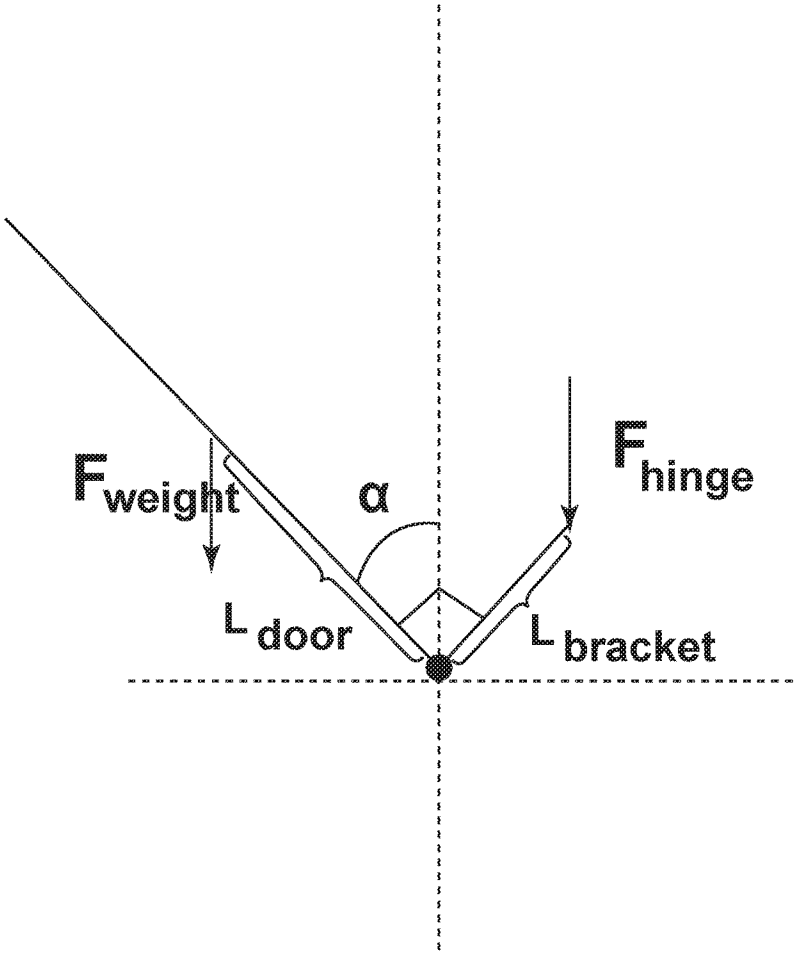
FIG. 4*b* is a free body diagram of the forces acting on the pulley and cam of the guide member.

The counterbalance assembly 12 includes a force applicator or biasing member 19, such as a tension spring. One end of the biasing member 19 is attached directly or indirectly to the cabinet 14 such as by a bracket 38, which may be an integrated part of the dishwasher cabinet 14. The opposite end of the biasing member 19 is coupled to the first flexible element 20*a*. The opposite end of the first flexible element 20*a* is coupled to an anchor 32 integrated within the first guide tracks 40 of the pulley 24. One end of a second flexible element 20*b* is coupled to a hinge bracket 28. The opposite end of the second flexible element 20*b* is coupled to an anchor 34, which can be integrated within the second guide tracks 42 of the cam 26. The flexible element 20*a* is configured to extend at least partially about the pulley 24 within the guide tracks 40 to apply a clockwise (as seen in FIG. 3) rotational force to the guide member 22. The mechanics of the counterbalance assembly 12 will be described in detail with references to FIGS. 4*a* and 4*b*. It should be noted that the forces are described with respect to the clockwise/counter-clockwise directions as seen in FIGS. 4*a* and 4*b*. However, the referential directions (clockwise/counter-clockwise) are not limiting and are used for ease of description. Also, it should further be noted that frictional forces are present, but will be ignored for simplicity of the description.

FIG. 4*a* schematically identifies the forces acting upon the guide member 22 such as the tension between the biasing member 19 and the force from the weight of the door 18 that is transferred through the hinge bracket 28. As the guide member 22 rotates about the axis 25, these forces can be translated into clockwise and counter-clockwise forces or torques.

The clockwise torque and counter-clockwise torque can be expressed in the following equations respectively:

$$T_{spring}=F_{spring}\cdot r_{pulley} \tag{1}$$

$$T_{door}=F_{door}\cdot\cos(\theta)\cdot r_{cam} \tag{2}$$

Wherein the various terms show the respective following meanings:

$T_{spring}$ is the clockwise torque provided by the tension of biasing member 19 through the flexible element 20*a*.

$F_{spring}$ is the tension force of the biasing member 19.

$r_{pulley}$ is an all-around fixed radius of the rotatable pulley 24.

$T_{door}$ is the counter-clockwise torque provided by the opening force applied by the user and the weight of the door 18.

$F_{door}$ is the force transferred from the weight of the door 18 to the flexible element 20*b* through the hinge bracket when the door 18 is in opened position.

θ is the constant angle of elevation of the flexible element 20*b* from the horizontal plane.

$r_{cam}$ is the varying radius of the cam 26 attached to the rotatable pulley.

For many of the functions achieved with the counter balance mechanism, it is helpful to knowing the equilibrium equation where the clockwise torque balances the counter-clockwise torque. When the torques are in equilibrium, the door will hold (i.e. true-hold), for example. When the torque from spring is greater than the torque from the door, the door will move toward the closed position (i.e. auto-close). When the torque from the door is greater than the torque from the spring, the door will move toward the opened position (i.e. slow-open).

A simplified version of the equilibrium equation can be derived by setting $T_{spring}$ equal to $T_{door}$ and solving the equation for the ratio of $r_{cam}/r_{pulley}$, which yields:

$$T_{spring}=T_{door}$$

$$F_{spring}\cdot r_{pulley}=F_{door}\cos(\theta)\cdot r_{cam}$$

$$r_{cam}/r_{pulley}=F_{spring}/F_{door}\cos(\theta) \tag{3}$$

As can be seen, the ratio of the radii, $r_{cam}$ and $r_{pulley}$, can be selected to control the degree of equilibrium or imbalance between the torques, $T_{door}$ and $T_{spring}$, to control the function of the door. As the torques, $T_{door}$ and $T_{spring}$, are functions of the rotational position of the door and the force of the spring, and will vary with door position and spring extension, these varying forces can likewise be accounted for in the torques.

While it is possible to vary both radii, $r_{cam}$ and $r_{pulley}$, to accomplish the desired function, it has been found sufficient to keep constant one of the radii while varying the other as needed to obtain the desired function. For purposes of this description, $r_{pulley}$ is selected to remain constant while $r_{cam}$ is varied, which results in the following equation:

$$r_{cam}=[F_{spring}\cdot r_{pulley}]/[F_{door}\cdot\cos(\theta)] \tag{4}$$

By varying the radius $r_{cam}$, the degree of balance or imbalance between the torques, $T_{door}$ and $T_{spring}$, can be controlled over the operation range to achieve any of the desired functions of at least hold, slow open, and auto close.

Referring to FIG. 4B, the equilibrium equation, in a more complex form, can be analyzed with respect to the angle, alpha, of the door with respect to the vertical. The counter clockwise rotational force $F_{door}$ generated by the opening of the door 18 will be elaborated as a function of the door angle. The force $F_{door}$ applied by the weight of the door 18 can be expressed in the following equation:

$$F_{door}=F_{hinge}/\sin(\theta) \quad (5)$$

As the door 18 and hinge bracket 28 may pivot about a hinge, the equilibrium torque between the weight of the door 18 relative to the hinge bracket 28 is expressed in the following equations:

$$F_{weight}\cdot L_{door}\cdot\sin(\alpha)=F_{hinge}\cdot L_{bracket}\cdot\cos(\alpha)$$

Making $F_{hinge}$ as the subject of the equation:

$$F_{hinge}=(L_{door}/L_{bracket})\cdot F_{weight}\cdot\tan(\alpha) \quad (6)$$

Substituting equation (6) to equation (5), the force $F_{door}$ applied by the weight of the door 18 can be expressed as a function of the door angle $\alpha$ in the following equation:

$$F_{door}=[(L_{door}/L_{bracket})\cdot F_{weight}\cdot\tan(\alpha)]/\sin(\theta) \quad (7)$$

Wherein the various terms show the respective following meanings:

$F_{door}$ is the force transferred from the weight of the door 18 to the flexible element 20*b* through the hinge bracket when the door 18 is in opened position.

$F_{hinge}$ is an upward vertical force of the hinge bracket created when the door pivots towards an opened position.

$\theta$ is the constant angle of elevation of the flexible element 20*b* from the horizontal plane.

$F_{weight}$ is the force created by gravity acting on the center of mass of the door.

$L_{door}$ is the length between the door pivot to the center of mass of the door.

$\alpha$ is the angle of door in opened position measured from the vertical axis.

$L_{bracket}$ is the length between the door pivot to the tip of the hinge bracket where it is connected to the flexible element 20*b*.

Substituting equation (7) into equation (2), the counter-clockwise torque acting upon the cam 26, $T_{door}$ can be expressed in the following equation:

$$T_{door}=(L_{door}/L_{bracket})\cdot F_{weight}\cdot r_{cam}\cdot(\tan(\alpha)/\tan(\theta)) \quad (8)$$

Referring to equations (1), (2), and (8), the equilibrium equation between the clockwise and counter-clockwise torques can be expressed in the following equations:

$$T_{spring}=T_{door}$$

$$F_{spring}\cdot r_{pulley}=(L_{door}/L_{bracket})\cdot F_{weight}\cdot r_{cam}\cdot(\tan(\alpha)/\tan(\theta)) \quad (9)$$

In order to create a counterbalancing function during the operational range of the door 18, the disparity between clockwise torque and counterclockwise torque have to be maintained to accomplish the desired function. For example, to affect the slow-open function, the clockwise torque needs to be less than the counter-clockwise torque near the opened position. Put another way, the counterbalance force needs to be less than the torque attributable to the weight of the door so the door can move into the open position. The amount that the clockwise torque is less than the counter-clockwise force will control the rate at which the door moves to the opened position and can be selected based on the desired rate. A position holding or true-hold function of the door 18 can be achieved if the clockwise torque is substantially equal to the counter-clockwise torque at a given door angle. Or, in other words, the counterbalance force of the counterbalance assembly can offset the torque associated with the weight of the door to hold the door in position. The presence of frictional forces provide a margin such that the clockwise and counter-clockwise forces need not be exactly equal to provide the holding function.

Referring to equation (7), to create the slow-open function, the clockwise torque needs to be less than the counter-clockwise torque near the opened position as expressed in the following equations:

$$T_{spring}<T_{door}$$

$$F_{spring}\cdot r_{pulley}<(L_{door}/L_{bracket})\cdot F_{weight}\cdot r_{cam}\cdot(\tan(\alpha)/\tan(\theta)) \quad (10)$$

The reverse application of the above equations can be used to create an auto-close function where the counterbalance force of the counterbalance assembly 12 is greater than the torque attributable to the weight of the door so the door is automatically moved into the closed position. In this case, the clockwise torque is larger than the counter-clockwise torque and is expressed by the following equation:

$$T_{spring}\geq T_{door}$$

$$F_{spring}\cdot r_{pulley}>(L_{door}/L_{bracket})F_{weight}\cdot r_{cam}\cdot(\tan(\alpha)/\tan(\theta)) \quad (11)$$

Based on the same equations, to create the position holding or true-hold function of the door 18, the clockwise torque must be substantially equal to the counter-clockwise torque at a given door angle $\alpha$ as expressed in the following equations:

$$T_{spring}=T_{door}$$

$$F_{spring}\cdot r_{pulley}=(L_{door}/L_{bracket})\cdot F_{weight}\cdot r_{cam}\cdot(\tan(\alpha)/\tan(\theta)) \quad (12)$$

Referring to equation (7), all the parameters will remain constant except for the dishwasher door angle, $\alpha$ which varies during the opening and closing of the door 18. Unique to the present embodiment, the cam 26 is designed with varying radius $r_{cam}$ from the axis of rotation 25 to create a counterbalancing function during the operational range of the door 18. As shown in FIG. 4*a*, when the door 18 is moving towards an opened or closed position, a varies and a pull force $F_{counter}$ from the hinge bracket 28 was applied to the guide track 42 of the cam 26 through the flexible element 20*b*. This resulted in the controlled rotation of the guide member 22 while the biasing member 19 creates an opposite clockwise torque on the guide member 22. As the guide member 22 rotates, the varying point of contact between the guide track 42 of the cam 26 and the flexible element 20*b* corresponds to a specific door angle, $\alpha$. To create an equilibrium or disparity between the clockwise torque and counter-clockwise torque acting on the guide member 22, the radius $r_{cam}$ of the cam 26 is configured at each point of contact to adept to the changes in the door angle, $\alpha$ to create a specific counterbalancing function. Referring to equation (8), to create a slow opening function, the required radius of the cam 26 to maintain the condition where clockwise torque is lesser than the counter-clockwise torque can be expressed in the following equation:

$$r_{cam}<F_{spring}\cdot r_{pulley}/[F_{weight}\cdot(L_{door}/L_{bracket})\cdot(\tan(\alpha/\tan(\theta))] \quad (13)$$

Referring to equation (9), to create an auto closing function, the required radius of the cam 26 to maintain the condition where clockwise torque is larger than the counter-clockwise torque can be expressed in the following equation:

$$r_{cam}>F_{spring}\cdot r_{pulley}/[F_{weight}\cdot(L_{door}/L_{bracket})\cdot(\tan(\alpha/\tan(\theta))] \quad (14)$$

Referring to equation (10), to create a position holding function, the required radius of the cam 26 to maintain torque equilibrium at varying door angle α can be expressed in the following equation:

$$r_{cam}=F_{spring}\cdot r_{pulley}/[F_{weight}\cdot(L_{door}/L_{bracket})\cdot(\tan(\alpha)/\tan(\theta))] \quad (15)$$

The unique design in which the cam 26 is affixed to one side of the pulley 24 where both parts rotate about an axis 25 as a single unit allows for the adjustability of the cam 26 dimension during the manufacturing stage to meet several combinations of the above balancing functions.

It should be recognized that the door true-hold function, auto-close function, and slow-open function can be implemented across the pivotal range of the door. In addition, one or more of the functions can be implemented across various angles of the pivotal range. For example, the door can be implemented to be held in a true-hold position at any angle across the pivotal range or the when the door is between certain angles such as when the door is not adjacent the open or close position. In other words, when the door is adjacent the open position, the slow-open function can be implemented, or, when the door is adjacent the closed position, the auto-close function can be implemented, and true hold function can be implemented at angles in between.

Although the embodiment of the present invention have been shown and described, it would be appreciated by those skilled in the art that changes may be made in these embodiments without departing from the principles and spirit of the invention. Although specific terms are employed herein, they are used in a generic and descriptive sense only and not for purposes of limitation.

I claim:

1. A dishwasher comprising:

a cabinet defining an access opening;

a door having a weight and hingedly mounted to the cabinet and pivotable about a door axis of rotation between a pivotal range between opened and closed positions to selectively open/close the access opening; and a counterbalance assembly coupling the cabinet to the door and comprising:

a guide member having a rotatable pulley rotating about a pulley axis of rotation and having a fixed radius from the pulley axis of rotation and a cam affixed to one side of the pulley and having a varying radius from the pulley; wherein the cam and the pulley rotate about the pulley axis of rotation as a single unit, a force applicator applying a counterbalance force to one of the pulley or cam, and a connector coupling the other of the pulley or cam to the door, wherein the counterbalance force applies a varying counterbalance torque to the door that is a function of a ratio between the fixed radius and the varying radius over the pivotal range of the door.

2. The dishwasher of claim 1 wherein the door defines an arc relative to the door's axis of rotation and pivotal range of the door is between 0 degrees when the door is in the closed position and 90 degrees when the door is in the open position.

3. The dishwasher of claim 2 wherein the pivotal range of the door further comprises a first portion adjacent the open position, a second portion adjacent the closed position, and a third portion between the first and second portions.

4. The dishwasher of claim 3 wherein the first portion of the pivotal range of the door is between about 75 and 90 degrees, the second portion is between about 0 to about 15 degrees, and the third portion is between about 15 and 75 degrees.

5. The dishwasher of claim 1 wherein the counterbalance force offsets the torque associated with the weight of the door to hold the door in position.

6. The dishwasher of claim 5 wherein the counterbalance force offsets the torque associated with the weight of the door to hold the door in position at any angle over the pivotal range of the door.

7. The dishwasher of claim 3 wherein the counterbalance force is greater than the torque attributable to the weight of the door and the door is automatically moved into the closed position.

8. The dishwasher of claim 7 wherein the counterbalance force is greater than the torque attributable to the weight of the door and the door is automatically moved into the closed position when the door is in the second portion of the pivotal range and wherein the counterbalance force offsets the torque associated with the weight of the door to hold the door in position when the door is in the first or third portion of the pivotal range.

9. The dishwasher of claim 3 wherein the counterbalance force is lesser than the torque attributable to the weight of the door and the door is automatically moved into the open position.

10. The dishwasher of claim 9 wherein the counterbalance force is lesser than the torque attributable to the weight of the door and the door is automatically moved into the open position when the door is in the first portion of the pivotal range and wherein the counterbalance force offsets the torque associated with the weight of the door to hold the door in position when the door is in the second or third portion of the pivotal range.

11. The dishwasher of claim 3 wherein the counterbalance force is lesser than the torque attributable to the weight of the door and the door is automatically moved into the open position when the door is in the first portion of the pivotal range and wherein the counterbalance force is greater than the torque attributable to the weight of the door and the door is automatically moved into the closed position when the door is in the second portion of the pivotal range and wherein the counterbalance force offsets the torque associated with the weight of the door to hold the door in position when the door is in the third portion of the pivotal range.

12. An appliance comprising:

a cabinet defining an access opening;

a door having a weight and hingedly mounted to the cabinet and pivotable about a door axis of rotation between a pivotal range between opened and closed positions to selectively open/close the access opening; and a counterbalance assembly coupling the cabinet to the door and comprising:

a guide member having a rotatable pulley rotating about a pulley axis of rotation and having a fixed radius from the pulley axis of rotation and a cam affixed to one side of the pulley and having a varying radius from the pulley; wherein the cam and the pulley rotate about the pulley axis of rotation as a signal unit;

a force applicator applying a counterbalance force to one of the pulley or cam, and a connector coupling the other of the pulley or cam to the door, wherein the counterbalance force applies a varying counterbalance torque to the door that is a function of a ratio between the fixed radius and the varying radius over the pivotal range of the door.

13. The appliance of claim 12 wherein the door defines an arc relative to the door's axis of rotation and pivotal range of the door is between 0 degrees when the door is in the closed position and 90 degrees when the door is in the open position.

14. The appliance of claim 13 wherein the pivotal range of the door further comprises a first portion adjacent the open position, a second portion adjacent the closed position, and a third portion between the first and second portions.

15. The appliance of claim 14 wherein the first portion pivotal range of the door is between about 75 and 90 degrees, the second portion is between about 0 to about 15 degrees, and the third portion is between about 15 and 75 degrees.

16. The appliance of claim 12 wherein the counterbalance force offsets the torque associated with the weight of the door to hold the door in position.

17. The appliance of claim 16 wherein the counterbalance force offsets the torque associated with the weight of the door to hold the door in position at any angle over the pivotal range of the door.

18. The appliance of claim 14 wherein the counterbalance force is greater than the torque attributable to the weight of the door and the door is automatically moved into the closed position.

19. The appliance of claim 18 wherein the counterbalance force is greater than the torque attributable to the weight of the door and the door is automatically moved into the closed position when the door is in the second portion of the pivotal range and wherein the counterbalance force offsets the torque associated with the weight of the door to hold the door in position when the door is in the first or third portion of the pivotal range.

20. The appliance of claim 14 wherein the counterbalance force is lesser than the torque attributable to the weight of the door and the door is automatically moved into the open position.

21. The appliance of claim 20 wherein the counterbalance force is lesser than the torque attributable to the weight of the door and the door is automatically moved into the open position when the door is in the first portion of the pivotal range and wherein the counterbalance force offsets the torque associated with the weight of the door to hold the door in position when the door is in the second or third portion of the pivotal range.

22. The appliance of claim 20 wherein the counterbalance force is lesser than the torque attributable to the weight of the door and the door is automatically moved into the open position when the door is in the first portion of the pivotal range and wherein the counterbalance force is greater than the torque attributable to the weight of the door and the door is automatically moved into the closed position when the door is in the second portion of the pivotal range and wherein the counterbalance force offsets the torque associated with the weight of the door to hold the door in position when the door is in the third portion of the pivotal range.

* * * * *